US005419015A

United States Patent [19]

Garcia

[11] Patent Number: 5,419,015

[45] Date of Patent: May 30, 1995

[54] MOP WITH REMOVABLE INTERCHANGEABLE WORK PADS

[76] Inventor: Teddy Garcia, 3146 Nautilus Rd., Orange Park, Fla. 32068

[21] Appl. No.: 180,681

[22] Filed: Jan. 13, 1994

Related U.S. Application Data

[63] Continuation-in-part of Ser. No. 86,042, Jul. 6, 1993, abandoned.

[51] Int. Cl.[6] ..... A47L 13/16; A47L 13/20; A47L 13/46

[52] U.S. Cl. ..... 15/228; 15/144.2; 15/147.1; 15/209.1; 15/231; 15/244.3

[58] Field of Search ..... 15/144.2, 147.1, 147.2, 15/209.1, 223, 228, 231, 232, 244.1, 244.2, 244.3

[56] References Cited

U.S. PATENT DOCUMENTS

| | | | |
|---|---|---|---|
| 3,395,416 | 8/1968 | Hughes | 15/228 |
| 3,528,076 | 9/1970 | Anderson | 15/228 |
| 3,528,120 | 9/1970 | Lindstrom | 15/228 |
| 3,737,938 | 6/1973 | Saltzstein | 15/231 |
| 3,760,450 | 9/1973 | Griffin | 15/144.2 |
| 3,792,505 | 2/1974 | Saltzstein | 15/147.2 |
| 3,991,431 | 11/1976 | Thielen | 15/228 |
| 4,455,705 | 6/1984 | Graham | 15/244.2 |
| 4,477,938 | 10/1984 | Rogut | 15/209.1 |
| 4,580,307 | 4/1986 | Moss | 15/228 |
| 4,829,719 | 5/1989 | Braselton | 15/144.2 |
| 4,852,210 | 8/1989 | Krajicek | 15/231 |
| 4,971,471 | 11/1990 | Sloan | 15/228 |
| 5,003,659 | 4/1991 | Paepke | 15/145 |
| 5,140,717 | 8/1992 | Castagliola | 15/209.1 |

*Primary Examiner*—David A. Scherbel
*Assistant Examiner*—Randall E. Chin
*Attorney, Agent, or Firm*—Arthur G. Yeager

[57] ABSTRACT

A mop having a head attached to a handle and a rectangular work pad removably attached to a rectangular flat surface of the head by fabric hook fasteners. The hook fasteners are located in recessed areas of the corners so that the hooks extend downwardly slightly below the lower surface of the head so that the work pad is substantially parallel and juxtaposed with the lower surface of the head throughout contact therebetween.

10 Claims, 3 Drawing Sheets

MOP WITH REMOVABLE INTERCHANGEABLE WORK PADS

RELATED PATENT APPLICATIONS

This patent application is a continuation-in-part application of U.S. patent application Ser. No. 08/086,042 filed by Teddy Garcia on Jul. 6, 1993, now abandoned.

BACKGROUND OF THE INVENTION

Hand mops have been used for generations to dust, clean and polish floors, walls, ceilings and other surfaces. In earlier days mops had heads of fabric, yarns, sponges, or other soft absorbent materials permanently affixed to the end of a rod-like handle. Cleaning, wringing, and other renewal operations on the head were somewhat awkward with an elongated handle attached to the head. In more recent times there have been marketed mops with removable heads, frequently made of synthetic sponge material, but such heads are not always preferred for some cleaning operations. Fleeces, toweling, and felts are preferred for waxing, polishing, and the like. There has also appeared on the market the VELCRO fabric fastener in which fabric hooks and fabric loops, when pressed into each other, provide an excellent means of fastening one article to another and yet be easily releasable. The mop of this invention provides a mop with any of several work pads that can be interchangeably fastened to the mop head.

It is an object of this invention to provide a novel mop with releasably attachable work pads. It is another object of this invention to provide a novel mop with flat work pads attachable by means of a VELCRO fabric fastener employing fabric hooks and fabric loops. Still other objects will become apparent from the more detailed description below.

BRIEF SUMMARY OF THE INVENTION

This invention relates to a mop having a removable flat work pad, the mop having a flat rectangular support plate with a top surface and a bottom surface, the top surface being attached to an elongated handle by a universal joint means, and the bottom surface being planar and having four corners with a portion in each corner recessed upwardly from the bottom surface and having in each recessed portion a pad of fabric hooks. The work pad is a three layered soft, compressible cushion having an upper non-woven fabric layer fastenable to the fabric hook pads, a central layer of a synthetic foam material, and a lower layer of a selected sheet material adapted for use in mopping operations.

In specific and preferred embodiments of the invention, the lower layer of the work pad may contain abrasive materials, may be a type of toweling, may be a fleece, may be a chamois skin, or the like. The recessed portions on the bottom surface of the mop head should be sized to receive pads of fabric hooks with the hook ends projecting slightly downward beyond the bottom surface. The work pads preferably are larger than the support plate of the mop head so as to extend laterally outward beyond the perimeter of the support plate.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
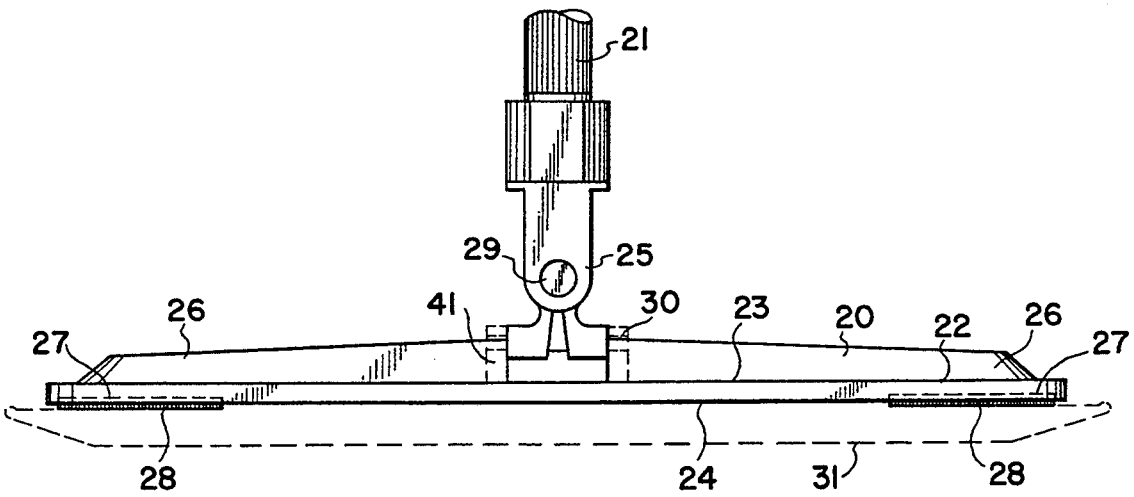
FIG. 1 is a front elevational view of the mop in accord with this invention.
Figure 2:
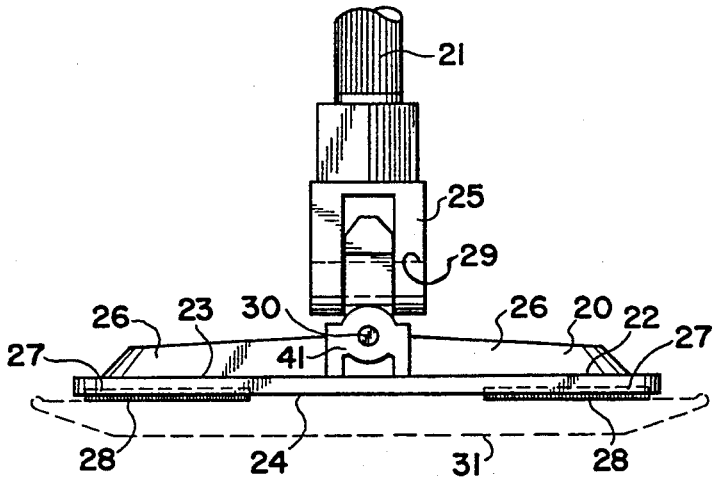
FIG. 2 is a side elevational view of FIG. 1.
Figure 3:
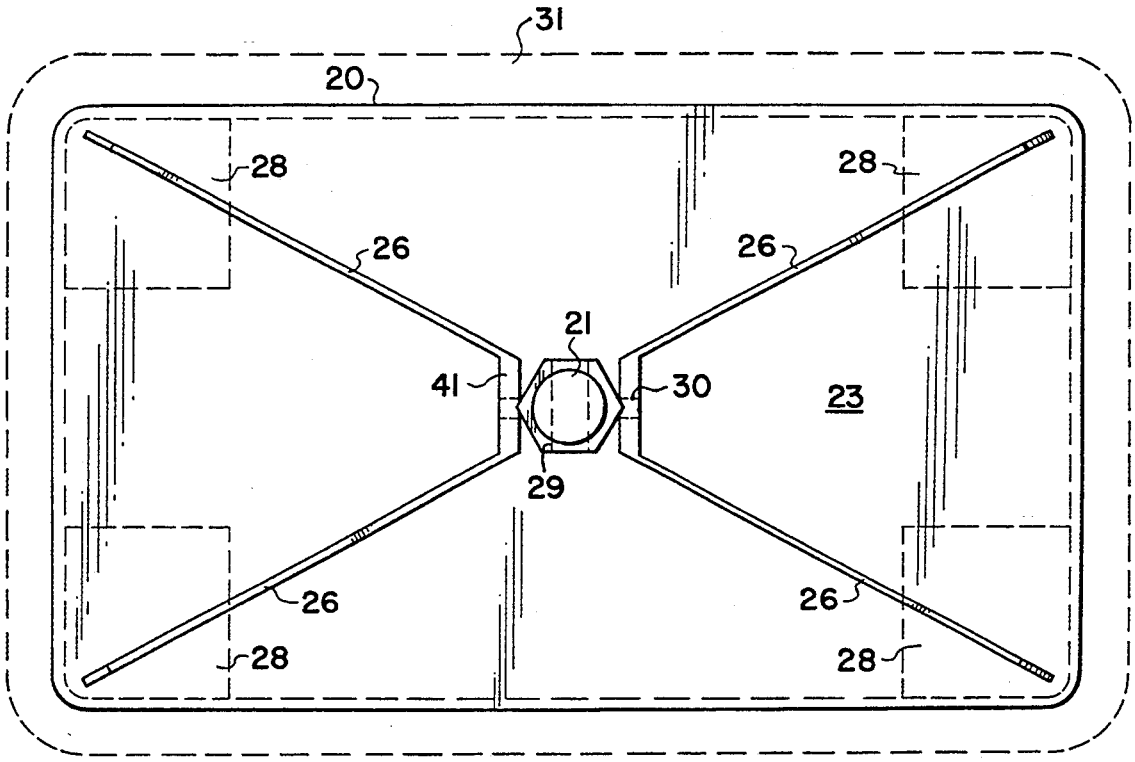
FIG. 3 is a top plan view of FIG. 1.
Figure 4:
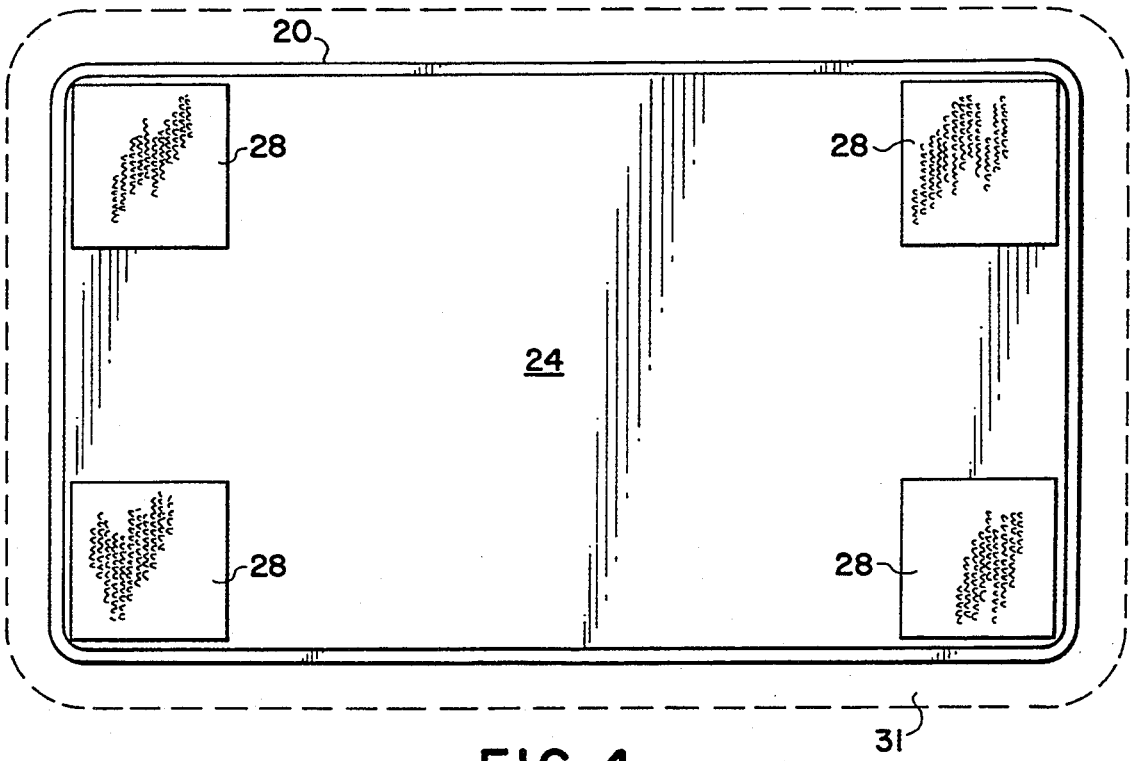
FIG. 4 is a bottom plan view of FIG. 1.

The details and embodiments of this invention are best understood by reference to the attached drawings.

The mop of this invention includes three elements; namely, the mop head 20, the mop handle 21, and the work pad 31. The mop head 20 and the mop handle 21 may be made of any rigid materials, such as wood, metal, plastic, or combinations of these basic materials. Plastic is preferred since in can be molded into a finished piece and thereby may be less expensive to manufacture. Handle 21 is an elongated rod of sufficient length for the job to be done, e.g., 4–6 feet for a floor mop and 6–10 feet for a wall or ceiling mop. Mop head 20 includes a flat support plate 22 having top surface 23 and a bottom surface 24. Top surface 22 has a central hub 41 from which radiate vertical reinforcement ribs 26 to eliminate flexibility of plate 22. Plate 22 is rectangular in the attached drawings and ribs 26 extend from hub 41 to the four corners of plate 22. Hub 41 and the lower end of handle 21 are joined via a universal joint means 25. In this instance the means includes an upper pivot pin or shaft 29 and a lower pivot pin or shaft 30. Pivots 29 and 30 are positioned at right angles to each other so as to permit handle 21 to be pivoted to almost any position while support plate 22 is kept in one position. Any other universal joint structure may be used to join handle 21 to support plate 22.

Figure 5:
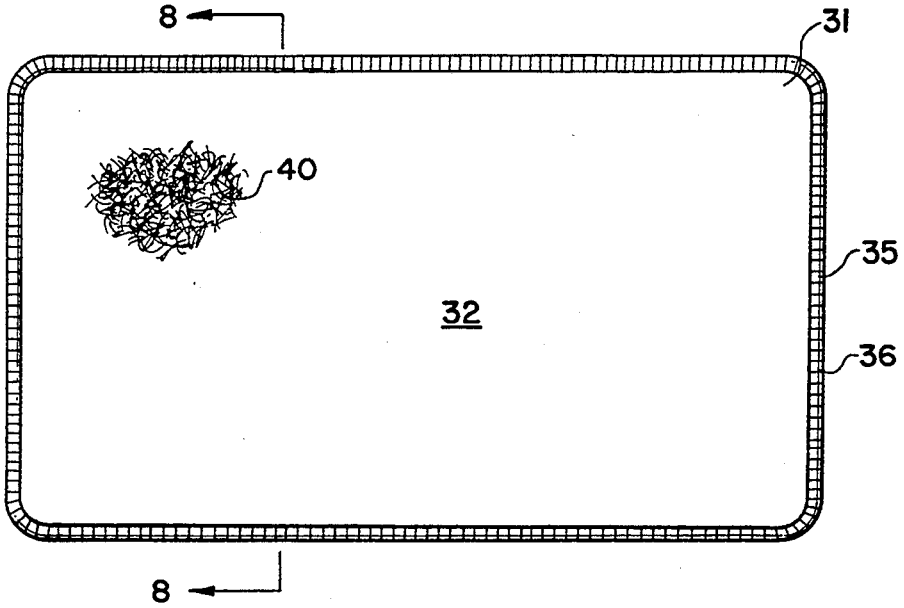
FIG. 5 is a top plan view of a work pad employed with the mop of this invention.
Figure 6:
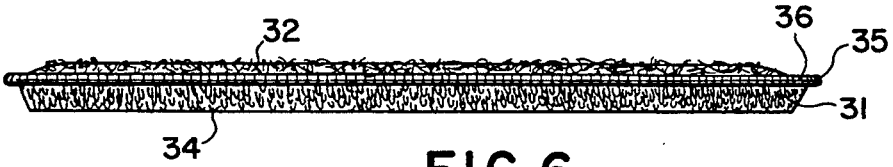
FIG. 6 is a front elevational view of FIG. 5.
Figure 7:
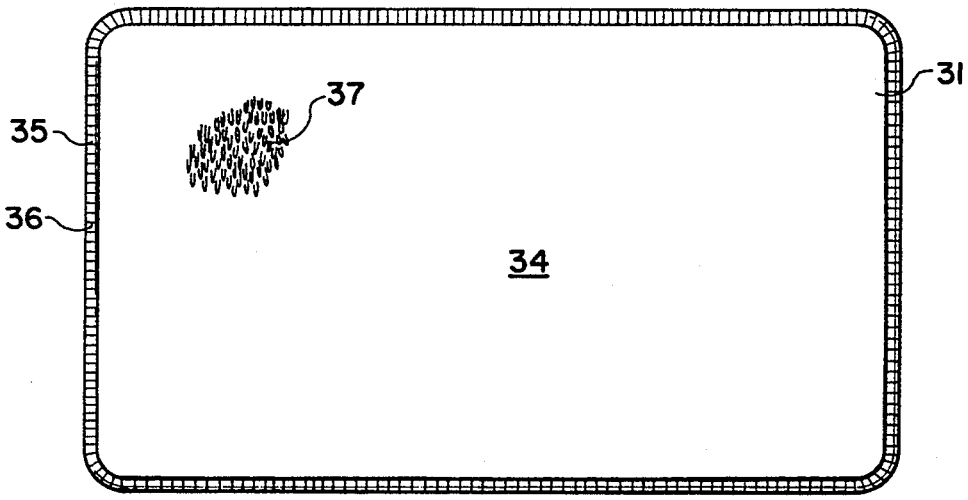
FIG. 7 is a bottom plan view of FIG. 5.
Figure 9:
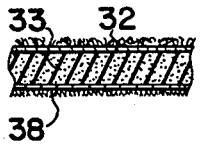
FIG. 9 is a partial cross-sectional view similar to FIG. 8, depicting a second embodiment of the work pad wherein the lower layer is a fleece material.
Figure 8:
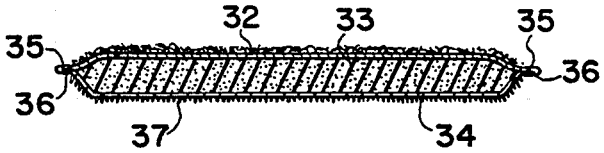
FIG. 8 is a cross-sectional view taken along line 8—8 of FIG. 5, showing a terry cloth lower surface.
Figure 10:
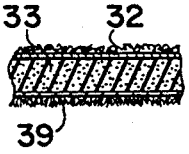
FIG. 10 is a partial cross-sectional view similar to FIGS. 8 and 9, showing a third embodiment of the work pad wherein the lower layer is an abrasive material.

Bottom surface 24 of support plate 22 is a flat planar surface against which work pad 31 (FIGS. 5–10) is fastened to perform whatever operation (e.g. washing, dusting, polishing, scrubbing, etc.) is to be undertaken by using the mop this invention. Work pad 31 is a flat cushion or compressible pad, and when fastened to bottom surface 24, the result is a flat-faced mop, rather than a bundle of strands or yarns, which provides a much better implement to work on a flat surface, such as a floor, wall, or ceiling. At each of the four corners of bottom surface 24 there is a shallow recessed portion 27 which is adapted to receive a pad 28 of fabric hooks of the type employed in a Velcro fabric fastener. The depth of the recessed portion is enough to permit about half of the thickness of pad 28 to be above the level of bottom surface 24, leaving only the hook ends of the pad 28 to be below the level of bottom surface 24, i.e., just enough to fasten themselves to the upper layer 32 of work pad 31. Pads 28 are preferably attached to recessed portions 27 by an adhesive which firmly affixes the backing fabric of pads 28 to the material from which mop head 20 is made. The total area of four pads 28 must be enough to fasten work pad 31 firmly to mop head 20. Any larger area of pads 28 is certainly operable, but generally is a waste of money. The proportion of the area of four pads 28 to the total area of bottom surface should be about 15–40%, preferably 20–30%. An actual preferred example of such proportions is for bottom surface to be 6.5×11 inches in size, while pads 28 are 2×2 inches in size. These sizes produce a proportion of about 22.4% of the total area of bottom surface being the area of four fabric hook pads 28.

Work pad 31 is a thin cushion (about $\frac{1}{4}$ to $\frac{3}{4}$ inch thick) which overlays bottom surface 24, and preferably extends a short distance beyond the perimeter of bottom surface 24, in all directions. For a bottom surface measuring 6.5×11 inches, work pad 31 preferably should measure about 8×12.5 inches, or an overlap of about 0.75 inch on each side. Smaller or larger bottom surfaces 24 might employ correspondingly smaller or larger overlaps, although an overlap of about 0.5–1.0 inch will be suitable for most sizes of mop heads 20.

Work pad 31 is composed of three layers fastened together, preferably by stitching around the perimeter. Upper layer 32 is made of a sheet material that is fastenable to the hooks of pads 28 on mop head 20. Layer 32 may be fabric loops such as used in Velcro fabric fasteners, or other material which will fasten to fabric hooks. Preferably, upper layer 32 is a non-woven fabric or a felt which has not been processed with a hard finish, but which retains a fibrous surface sufficient to be fastened to fabric hooks. Many soft felts or soft non-woven materials are available on the market today with such properties, and may be natural or synthetic materials. Central layer 33 is a microporous foam of synthetic plastic material e.g., polyolefin, polyamide, polyvinyl, or the like. Lower layer 34 is a sheet of any selected fabric that has utility in mopping operations. For washing operations, lower layer 34 may be a terry cloth toweling, a woven fibrous material, a non-woven fibrous material, a spongy material, or the like. For dusting and polishing operations lower layer 34 may be a fleece, a shaggy fabric, or a terry cloth toweling including a multiplicity of long fibers, as identified by numeral 39 in FIG. 10. For scrubbing operations lower layer 34 may be an abrasive sheet material, a spongy material, or a shaggy fabric, as identified by numeral 38 in FIG. 9. For certain operations lower layer may be a chamois skin, or other leather-like material. In other words, lower layer 34 may be any selected material appropriate for the mopping operation.

The three layers 32, 33, and 34 of work pad 31 are joined together around the outside perimeter in any convenient manner, e.g., by adhesive bonding, stitching, or the like. Shown in the drawings is a rolled edge 35 held in place by stitching 36 around the perimeter. The central layer 33 may be laminated to upper layer 32 with the lower layer 34, or 38 or 39 being stitched to the laminated central and upper layers 33, 32. Work pad 31 is washable so that it may be washed by hand or otherwise.

Other shapes and sizes of mop head 20 and work pad 31 may be employed, such as round, elliptical, triangular, or the like, although rectangular is preferred.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

I claim:

1. A mop comprising an elongated handle and a flat rectangular support plate having a perimeter and a top surface and a bottom surface, a universal joint means connecting said handle to said top surface, said bottom surface being planar and having four corners, each corner only containing a thin pad of fabric hooks with the remainder of said bottom surface being clear of any fabric hooks, a removable work pad being flexible and having a rectangular perimeter and extending outwardly beyond said perimeter of said support plate, said work pad having an upper planar layer of a non-woven fabric fastenable to said pads of fabric hooks, a central planar layer of a foamed synthetic plastic material, and a lower planar layer of a selected sheet material adapted to be used in a mopping operation, said corners of said bottom surface of said support plate, having square shallow depressions therein, said pads of fabric hooks being square and positioned in and filling respective said shallow depressions in said bottom surface of said support plate, said depressions being of a depth to permit said pads to extend generally half their thickness above said bottom surface of said support plate and to dispose said upper planar layer of said work pad flat against said bottom surface of said support plate and said pads of fabric hooks, and to dispose said lower layer of said work pad to be substantially planar when said upper layer is attached to said plate.

2. The mop of claim 1 wherein said central layer and said upper layer are laminated and said lower layer is stitched to said central and upper layers around said perimeter of said work pad, and forming a work pad about $\frac{1}{4}$ to $\frac{3}{4}$ inch thick.

3. The mop of claim 2 wherein said lower layer of said work pad is terry cloth.

4. The mop of claim 2 wherein said lower layer of said work pad is abrasive.

5. The mop of claim 2 wherein said lower layer of said work pad has a shaggy texture.

6. A mop with a plurality of interchangeable work pads comprising an elongated handle having opposite ends, a flat rectangular support plate having a perimeter and a top surface and a bottom surface, universal joint means for connecting one of said ends of said handle to said top surface, said bottom surface being planar and having four rectangular corner areas, a thin rectangular sheet member of fabric hooks disposed in each said corner areas with its hooks exposed adjacent said bottom surface, each said work pad being flexible and rectangular and extending outwardly of said perimeter of said support plate, said work pad having an upper planar layer being composed of a non-woven fabric fastenable to said sheet members of fabric hooks, a central planar layer of a foamed synthetic plastic material laminated to said upper layer, and a lower planar layer of a selected sheet material carried by said upper and central layers, said work pad being stitched around its perimeter to join together said lower planar layer to said laminated upper and central planar layers, said corner areas of said support plate being recessed upwardly to form shallow depressions, said sheet members of fabric hooks being positioned in said shallow depressions of said corner areas of said support plate with their hooks extending slightly below said bottom surface, said depressions being of a depth to permit said planar upper layer of said work pad to remain substantially planar when said upper layer is attached by said sheet members of fabric hooks to said support plate and said lower planar layer of said work pad being parallel therewith.

7. The mop of claim 6 wherein said lower layer of one said work pad is terry cloth.

8. The mop of claim 6 wherein said lower layer of one said work pad is abrasive.

9. The mop of claim 6 wherein said lower layer of one said work pad includes a multiplicity of long fibers used for dusting.

10. The mop of claim 6 wherein said lower layer of one said work pad is terry cloth, said lower layer of a second said work pad is abrasive and said lower layer of a third said work pad includes a multiplicity of long fibers used for dusting.

* * * * *